US008942601B2

(12) United States Patent
Fujii

(10) Patent No.: US 8,942,601 B2
(45) Date of Patent: Jan. 27, 2015

(54) DEVELOPER STORAGE CONTAINER, IMAGE FORMING UNIT AND IMAGE FORMING APPARATUS

(75) Inventor: Masashi Fujii, Tokyo (JP)

(73) Assignee: Oki Data Corporation, Tokyo (JP)

( * ) Notice: Subject to any disclaimer, the term of this patent is extended or adjusted under 35 U.S.C. 154(b) by 404 days.

(21) Appl. No.: 13/177,595

(22) Filed: Jul. 7, 2011

(65) Prior Publication Data

US 2012/0008989 A1 Jan. 12, 2012

(30) Foreign Application Priority Data

Jul. 7, 2010 (JP) ..... 2010-154427

(51) Int. Cl.
*G03G 15/08* (2006.01)

(52) U.S. Cl.
CPC ..... *G03G 15/0889* (2013.01); *G03G 15/0832* (2013.01); *G03G 2215/0852* (2013.01)
USPC ..... 399/263; 399/254

(58) Field of Classification Search
CPC ..... G03G 15/0832; G03G 15/0889; G03G 2215/0852
USPC ..... 399/119, 120, 263, 153, 254
See application file for complete search history.

(56) References Cited

U.S. PATENT DOCUMENTS 5,202,732 A * 4/1993 Yahata ..... 399/263
5,655,195 A * 8/1997 Ichikawa et al. ..... 399/263
RE37,542 E * 2/2002 Ichikawa et al. ..... 399/263
6,385,422 B1 * 5/2002 Ishiguro et al. ..... 399/258
6,415,126 B2 * 7/2002 Kaneshige et al. ..... 399/256
6,456,810 B1 * 9/2002 Deguchi et al. ..... 399/254
6,459,876 B1 * 10/2002 Buchanan et al. ..... 399/254
6,463,234 B2 * 10/2002 Arimitsu et al. ..... 399/113
6,546,213 B2 * 4/2003 Ito et al. ..... 399/27
6,622,001 B2 * 9/2003 Arimitsu et al. ..... 399/358
6,892,036 B2 * 5/2005 Ito ..... 399/27
7,509,081 B2 * 3/2009 Bessette ..... 399/263
7,680,442 B2 * 3/2010 Muramoto et al. ..... 399/254
7,899,367 B2 * 3/2011 Fukuta ..... 399/254
8,036,581 B2 * 10/2011 Baek ..... 399/281
8,204,410 B2 * 6/2012 Yamazaki et al. ..... 399/263
8,463,163 B2 * 6/2013 Goto ..... 399/254
2007/0147859 A1 6/2007 Adachi et al.
2009/0060593 A1 * 3/2009 Baek ..... 399/281
2011/0135343 A1 * 6/2011 Goto ..... 399/254
2011/0182639 A1 * 7/2011 Kim et al. ..... 399/358

FOREIGN PATENT DOCUMENTS

EP 1-953-610 A1 8/2008
EP 2357538 A1 8/2011

(Continued)

OTHER PUBLICATIONS

Machine translation of Japanese reference JP 05181359. Jul. 23, 1993.*

*Primary Examiner* — David Gray
*Assistant Examiner* — Carla Therrien
(74) *Attorney, Agent, or Firm* — Rabin & Berdo, P.C.

(57) ABSTRACT

A developer storage container includes a developer storage portion in which a developer is stored, the developer storage portion having a wall, a rotating body rotatably provided in the developer storage portion, and an agitating plate that engages the rotating body and agitates the developer at least in the vicinity of the wall.

27 Claims, 10 Drawing Sheets

(56) References Cited

FOREIGN PATENT DOCUMENTS

| | | | | | |
|---|---|---|---|---|---|
| JP | S53-047834 | U | | 4/1978 | |
| JP | S58-157346 | U | | 10/1983 | |
| JP | 61138968 | A | | 6/1986 | |
| JP | 05-181359 | A | | 7/1993 | |
| JP | 06308826 | A | * | 11/1994 | G03G 15/08 |
| JP | 10069166 | A | * | 3/1998 | G03G 15/08 |
| JP | 2003-050505 | A | | 2/2003 | |
| JP | 2003162191 | A | * | 6/2003 | G03G 21/10 |

* cited by examiner

DEVELOPER STORAGE CONTAINER, IMAGE FORMING UNIT AND IMAGE FORMING APPARATUS

BACKGROUND OF THE INVENTION

The present invention relates to a developer storage container, an image forming unit and an image forming apparatus.

An image forming apparatus includes a developer storage container such as a toner cartridge in which a developer such as a toner is stored. The developer storage container has an elongated opening at a bottom, through which the developer is ejected outside. In the developer storage container having a large capacity (i.e., a large inner space), an agitating member is provided for efficiently ejecting the developer from the developer storage container through the elongated opening.

For example, Japanese Laid-open Patent Publication No. 2003-050505 discloses a toner cartridge having an agitating member and a toner remaining amount detecting mechanism therein.

However, in the conventional art, when a large amount of the developer is stored in the developer storage container, it becomes difficult to efficiently eject the developer outside from the developer storage container.

SUMMARY OF THE INVENTION

In an aspect of the present invention, it is intended to provide a developer storage container capable of efficiently ejecting a developer outside, and to provide an image forming unit and an image forming apparatus using such a developer storage container.

According to an aspect of the present invention, there is provided a developer storage container including a developer storage portion in which a developer is stored and which has a wall, a rotation body rotatably provided in said developer storage portion, and an agitating plate that engages said rotation body and agitates the developer at least in the vicinity of the wall.

With such a configuration, the developer can be efficiently ejected outside from the developer storage container.

According to still another aspect of the present invention, there is provided an image forming unit including the above described developer storage container.

According to yet another aspect of the present invention, there is provided an image forming apparatus including the above described developer storage container.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings.

First Embodiment

<Configuration>

Figure 1:
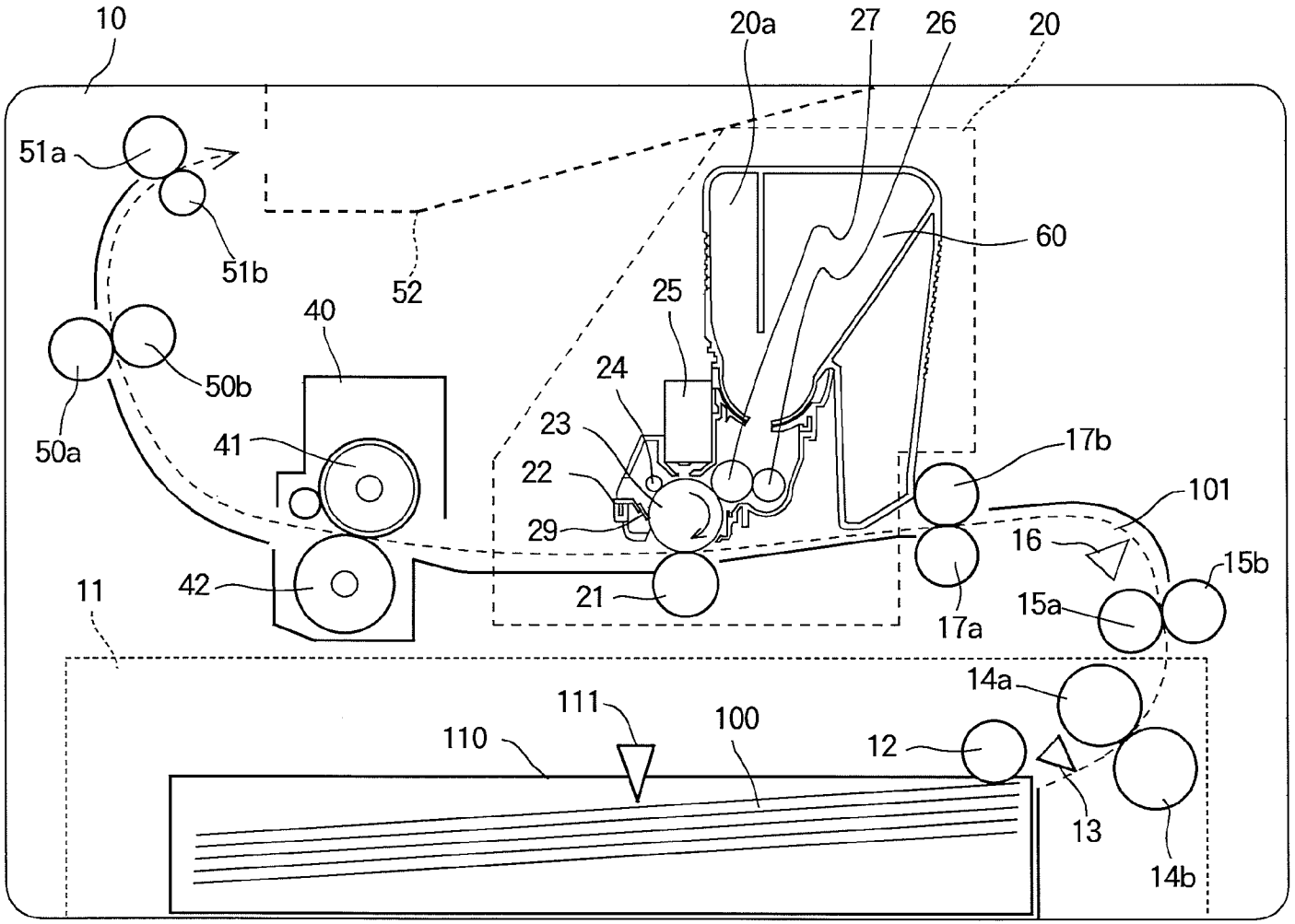
FIG. 1 is a schematic side view of an image forming apparatus according to the first embodiment of the present invention.

FIG. 1 is a schematic sectional view showing an image forming apparatus 10 according to the first embodiment of the present invention. The image forming apparatus 10 includes a feeding portion 11 that feeds a recording medium 100 (for example, a sheet) and a transport path 101 along which the recording medium 100 is transported. Along the transport path 101, the image forming apparatus 10 includes transport rollers 15*a* and 15*b* that transport the recording medium 100 along the transport path 101, a writing sensor 16 that detects a passage of a leading edge of the recording medium 100, and registration rollers 17*a* and 17*b* that correct a skew of the recording medium 100 and further transport the recording medium 100. The image forming apparatus 10 further includes an image forming portion 20 that forms a toner image (i.e., a developer image) on the recording medium 100, a fixing portion 40 that fixes the toner image to the recording medium 100, an ejection mechanism that ejects the recording medium 100 outside the image forming apparatus 10, and a stacker portion 52 that stores the ejected recording medium 100.

Further, the image forming apparatus 10 includes not shown motors for rotating the respective rollers, a clutch for connecting or disconnecting a transmission of power to the respective rollers disposed along the transport path 101, high voltage power sources for applying high voltages of 200-5000V to a charging roller 24 and a transfer roller 21 or the like of the image forming portion 20, and a low voltage power sources for applying low direct voltages of 5V and 24V to circuits or the motors.

A feeding cassette 110 of the feeding portion 11 constitutes a recording medium storage unit that stores the recording media 100. The fixing portion 40 constitutes a fixing unit that fixes the toner image to the recording medium 100 by application of heat and pressure. The feeding portion 11, the transport rollers 15*a*, 15*b* and the registration rollers 17*a* and 17*b* constitute a medium transport unit that transports the medium 100 to the fixing portion 40.

The feeding portion 11 includes the feeding cassette 110 storing the recording media 100 and mounted to a lower part of the image forming apparatus 10. The feeding portion 11 further includes a sensor 111 for detecting presence/absence of the recording medium 100 in the feeding cassette 110, a pickup roller 12 that feeds the recording medium 100 one by one from the feeding cassette 110 in cooperation with a separation tongue piece, a hopping sensor 13 that detects whether the recording medium 100 is being fed, a feeding roller 14*a* and a retard roller 14*b*.

The feeding cassette 110 is a configured to store a plurality of stacked recording media 100, and is detachably mounted to the lower part of the image forming apparatus 10. The recording medium 100 is, for example, a high-quality paper, a recycled paper, a gross paper, a Mat paper, an OHP (Overhead Projector) film or the like having a predetermined size used for printing a monochrome or color image thereon.

The pickup roller 12 is pressed against the recording medium 100, and rotates to feed the recording medium 100 out of the feeding cassette 110. The hopping sensor 13 is provided on downstream side of the pickup roller 12 along the transport path 101. The feeding roller 14*a* and the retard roller 14*b* are provided on downstream side of the hopping sensor 13 along the transport path 101 so as to face each other via the recording medium 100.

The transport rollers 15*a* and 15*b* are provided on downstream side of the feeding portion 11 along the transport path 101 so as to face each other via the recording medium 100. The feeding roller 15*a* is driven by a feeding motor (not shown).

The registration rollers 17*a* and 17*b* are provided on downstream side of the transport rollers 15*a* and 15*b* along the transport path 101 so as to face each other via the recording medium 100. The registration roller 17*a* is driven by a registration motor (not shown).

The image forming portion 20 can be divided into three sections: an image forming unit 20*a*, a transfer roller 21 and an LED (Light Emitting Diode) head 25. The LED head 25 is mounted to a main body (i.e., an image forming unit main body 22) of the image forming unit 20*a*, and emits light to expose the surface of the photosensitive drum 23 based on image data. Further, the image forming unit 20*a* can be divided into the image forming unit main body 22 and a toner cartridge 60 as a developer storage container mounted on the image forming unit main body 22.

The image forming unit main body 22 includes a photosensitive drum 23 that bears a latent image, a charging roller 24 as a charging member that uniformly charges the surface of the photosensitive drum 23, a developing roller 27 as a developer bearing body that develops the latent image on the surface of the photosensitive drum 23 using a toner 90 as a developer, and a sponge roller 26 as a supply roller (or a supply member) that supplies the toner 90 to the developing roller 27. The image forming unit main body 22 further includes a developing blade 28 (FIG. 2) that regulates a thickness of the toner layer on the surface of the developing roller 27, and a cleaning blade 29 that removes the residual toner from the photosensitive drum 23.

The developing roller 27, the sponge roller 26 and the developing blade 28 constitute a developing unit.

The photosensitive drum 23 includes a conductive base layer made of aluminum or the like and a photoconductive layer formed on the conductive base layer. The photoconductive layer includes a charge generation layer and a charge transport layer. The photosensitive drum 23 has a cylindrical shape, and is rotatably supported. The photosensitive drum 23 contacts the charging roller 24, the transfer roller 21, the developing roller 27, and an end portion of the cleaning blade 29. The photosensitive drum 23 is able to hold electric charge at a surface thereof, and functions as an image bearing body that bears a toner image. The photosensitive drum 23 rotates in a direction shown by an arrow in FIG. 1. Hereinafter, components provided around the photosensitive drum 23 will be described along the rotational direction of the photosensitive drum 23.

The charging roller 24 is composed of a metal shaft having electrical conductivity covered with a semiconductive rubber such as a silicone rubber, and has a cylindrical shape. The charging roller 24 is rotatably supported, and is pressed against the photosensitive drum 23. The charging roller 24 is applied with a voltage by a charging power source (not shown). As the charging roller 24 rotates while being pressed against the photosensitive drum 23, the charging roller 24 applies a predetermined voltage to the photosensitive drum 23, so as to uniformly charge the surface of the photosensitive drum 23.

The LED head 25 includes a plurality of LEDs, a lens array and LED driving elements, and is provided above the photosensitive drum 23. The LED head 25 is configured to emit light so as to expose the surface of the photosensitive drum 23 based on image data.

The sponge roller 26 is composed of a metal shaft having electrical conductivity covered with a sponge, and has a cylindrical shape. The sponge roller 26 is provided contacting the surface of the developing roller 27. The sponge roller 26 is applied with a voltage by a supply power source (not shown). As the sponge roller 26 contacts the developing roller 27, the sponge roller 26 supplies the toner 90 to the developing roller 27.

The developing roller 27 is composed of a metal shaft having electrical conductivity covered with a semiconductive urethane rubber or the like, and has a cylindrical shape. The developing roller 27 contacts the sponge roller 26, the photosensitive drum 23 and an end portion the developing blade 28. The developing roller 27 is applied with a voltage by a developing power source (not shown). The developing roller 27 causes the toner 90 to adhere to the latent image formed on the photosensitive drum 23 (i.e., develops the latent image) so as to form a toner image.

The developing blade 28 as a developer layer regulating member is formed of stainless or the like, and has a plate shape. The developing blade 28 is provided so that the end portion of the developing blade 28 contacts the surface of the developing roller 27. The developing blade 28 regulates a thickness of the toner layer on the surface of the developing roller 27 to a constant thickness by scraping off excessive amount of the toner 90 on the developing roller 27.

The cleaning blade 29 as a cleaning member is made of rubber or the like, and has a plate shape. The cleaning blade 29 is provided so that the end portion of the cleaning blade 29 contacts the surface of the photosensitive drum 23. The cleaning blade 29 cleans the surface of the photosensitive drum 23 by scraping off the residual toner that remains on the photosensitive drum 23 after the toner image is transferred to the recording medium 100.

The fixing portion 40 as the fixing unit includes a fixing roller 41 and a backup roller 42, and is configured to fix the toner image to the recording medium 100 by applying heat and pressure.

A pair of ejection rollers 50*a* and 50*b* and another pair of ejection rollers 51*a* and 51*b* are provided on downstream side of the fixing portion 40 along the transport path 101. The ejection rollers 50*a* and 50*b* face each other via the recording medium 100, and the ejection rollers 51*a* and 51*b* face each other via the recording medium 100. The ejection rollers 50*a*, 50*b*, 51*a* and 51*b* are respectively driven by an ejection motor (not shown).

Figure 2:
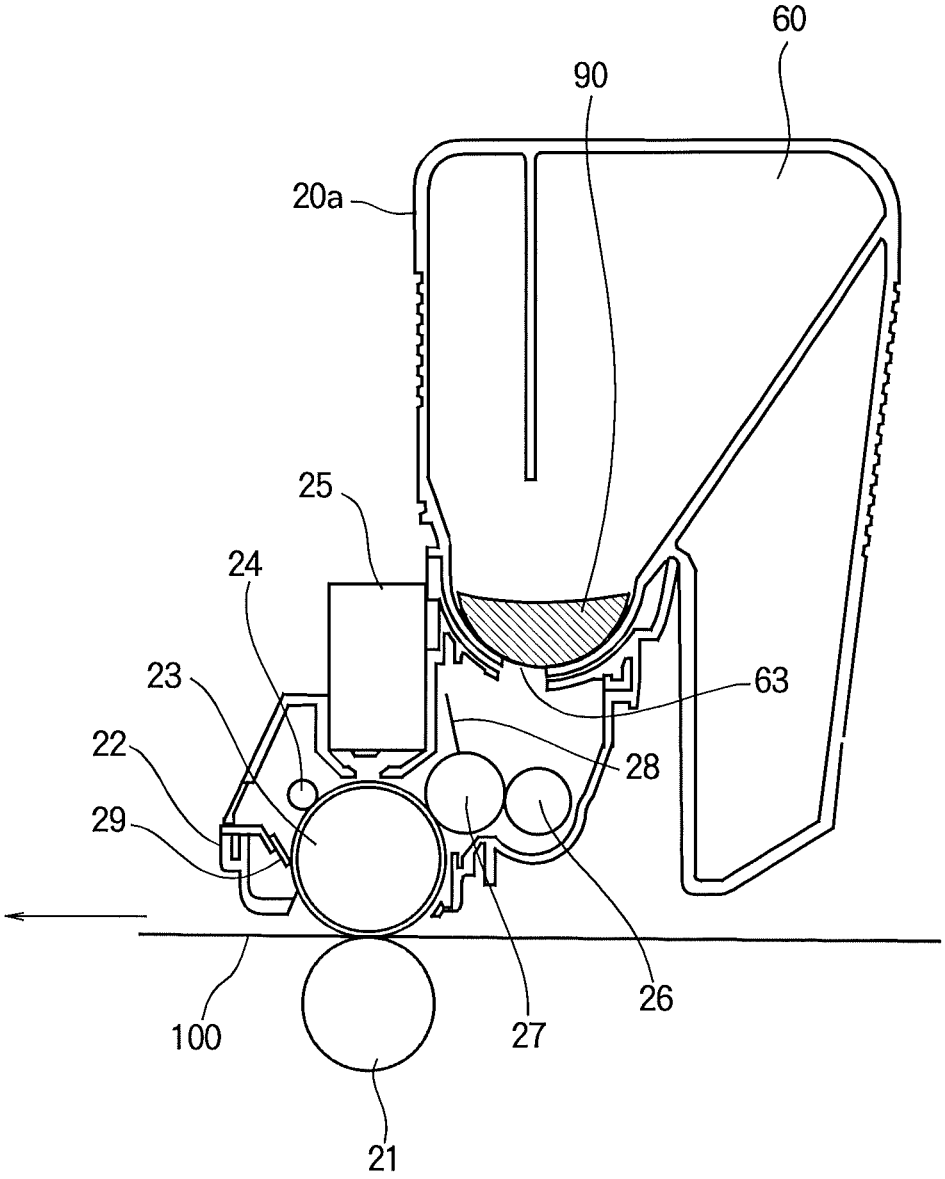
FIG. 2 is a cross sectional view of an image forming unit according to the first embodiment of the present invention.

FIG. 2 is a schematic view showing the image forming unit 20*a*, the LED head 25, the transfer roller 21 and the recording medium 100 according to the first embodiment.

As described above, the image forming portion 20 can be divided into the image forming unit 20*a*, the transfer roller 21 and the LED head 25. The LED head 25 is mounted to the image forming unit main body 22, and emits light to expose the surface of the photosensitive drum 23 based on image data. Further, the image forming unit 20*a* can be divided into the image forming unit main body 22 and the toner cartridge 60 detachably mounted to the image forming unit main body 22.

Further, as described above, the image forming unit main body 22 includes the photosensitive drum 23 that bears a latent image, the charging roller 24 that uniformly charges the surface of the photosensitive drum 23, the developing roller 27 that develops the latent image on the surface of the photosensitive drum 23 using the toner 90, the sponge roller 26 that supplies the toner 90 to the developing roller 27, the developing blade 28, and the cleaning blade 29 that removes the residual toner from the photosensitive drum 23.

The photosensitive drum 23 as the image bearing body is rotated by a drum motor (not shown), and electric charge of the surface of the photosensitive drum 23 is removed by being exposed to light, so that a latent image is formed on the surface of the photosensitive drum 23.

The charging roller 24 is pressed against the surface of the photosensitive drum 23, and rotates accompanying the rotation of the photosensitive drum 23 to supply a predetermined charge to the surface of the photosensitive drum 23.

The LED head 25 is provided above the photosensitive drum 23, and emits light to expose the surface of the photosensitive drum 23 (having been uniformly charged by the charging roller 24) to thereby form a latent image.

The toner cartridge 60 is located on an upper part of the image forming portion 20. The toner cartridge 60 stores the toner 90 therein. The toner cartridge 60 has a supply opening (i.e., an outlet opening) 63 formed on a bottom, through which the toner 90 is supplied to the image forming unit main body 22.

The image forming unit main body 22 includes the developing roller 27 that supplies the toner 90 (supplied by the toner cartridge 60) to the photosensitive drum 23, the sponge roller 26 that supplies the toner 90 to the developing roller 27, and the developing blade 28 that regulates the thickness of the layer of the toner 90 on the developing roller 27. The developing roller 27 is pressed against the photosensitive drum 23 at a predetermined pressure. The transfer roller 21 as the transfer member is provided below the photosensitive drum 23. The photosensitive drum 23 and the transfer roller 21 nip the recording medium 100 therebetween and feed the recording medium 100, so as to transfer the toner image to the recording medium 100.

Figure 3:
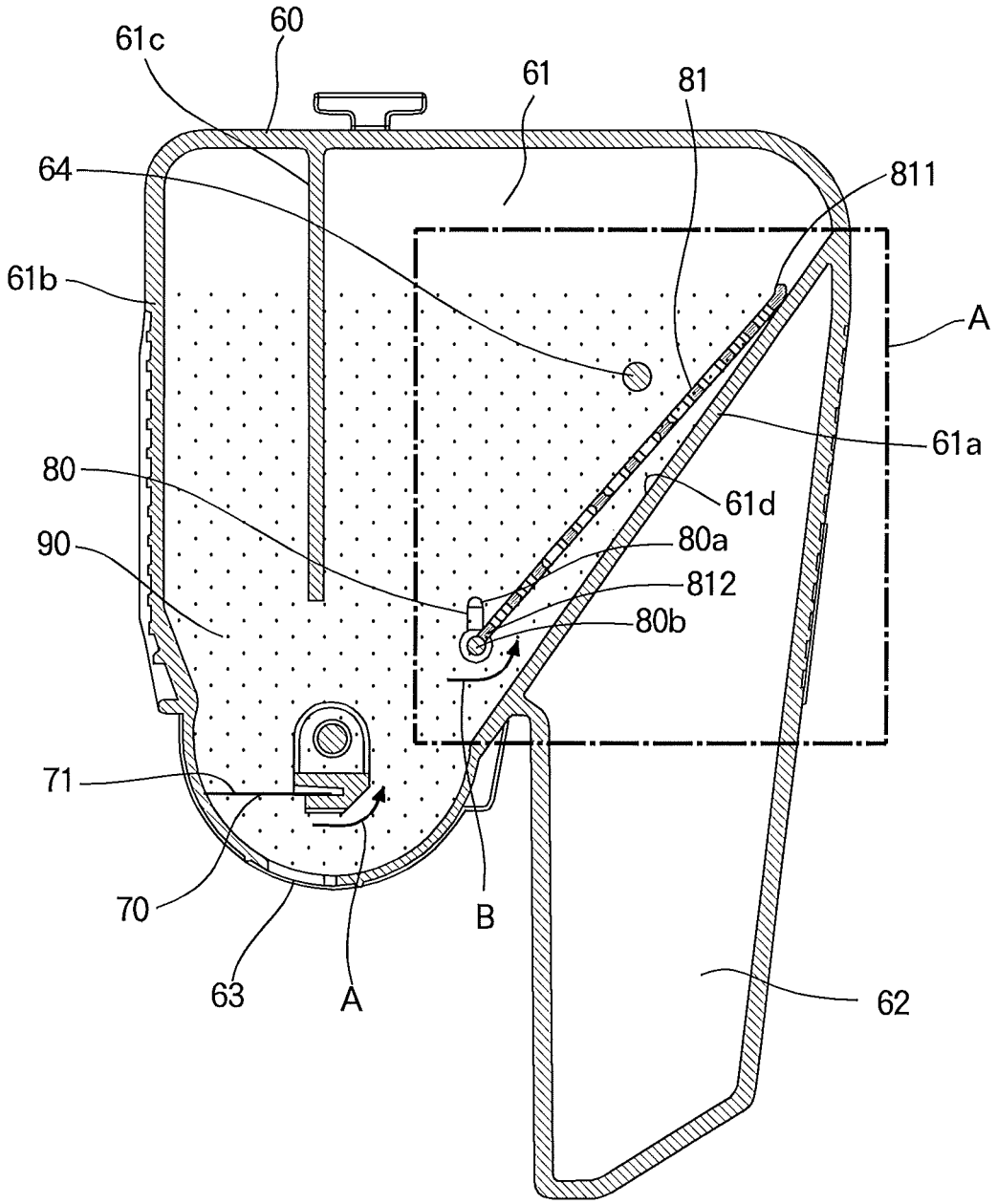
FIG. 3 is a cross sectional view of a toner cartridge according to the first embodiment of the present invention.

FIG. 3 is a cross sectional view showing the toner cartridge 60 according to the first embodiment, cut along a plane perpendicular to the longitudinal direction of the toner cartridge 60.

The toner cartridge 60 includes a toner storage portion 61 as a developer storage portion for storing the toner 90 (i.e., a fresh toner), and a waste toner storage portion 62 as a waste developer storage portion for storing a waste toner. The toner storage portion 61 and the waste toner storage portion 62 both extend in the longitudinal direction of the toner cartridge 60.

The toner storage portion 61 has two walls 61*a* and 61*b* facing each other and extending in the longitudinal direction of the toner cartridge 60. The wall 61*b* is provided upright, and the wall 61*a* is inclined. Due to the inclination of the wall 61*a*, a width of the toner storage portion 61 in the left-right direction (FIG. 3) decreases in downward direction. Between the walls 61*a* and 61*b*, a partition wall 61*c* is provided upright. With such a structure, the toner cartridge 60 is able to store a maximum amount of the toner 90 with respect to a planar projected area that the toner cartridge 60 occupies in the image forming apparatus 10.

The supply opening 63 is formed on the bottom of the toner storage portion 61. The supply opening 63 has an elongated shape, and is oriented in the longitudinal direction of the toner storage portion 61. The toner storage portion 61 stores the toner 90 therein.

An agitating member 70 (also referred to as a lower agitating member) is provided in the toner storage portion and is located above the supply opening 63. The agitating member 70 has a flexible member 71 such as a film at a tip. A crank bar 80 is provided above the agitating member 70, and extends in the longitudinal direction of the toner storage portion 61. The crank bar 80 functions as a rotating body that rotates (operates) in association with the agitating member 70. A rotation of the agitating member 70 is transmitted to the crank bar 80 via a gear train (not shown).

Figure 4A:
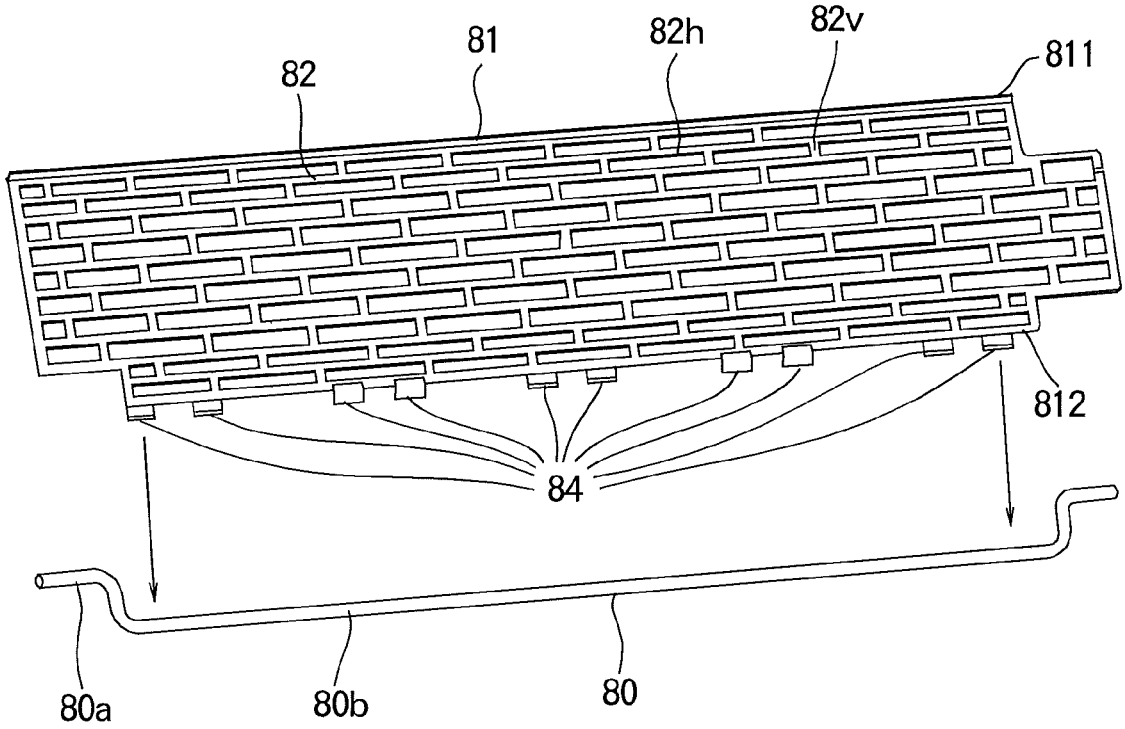
FIG. 4A shows a crank bar and an agitating plate according to the first embodiment of the present invention.

FIG. 4A is a schematic perspective view of the crank bar 80 and an agitating plate 81. The crank bar 80 includes a rotation shaft 80*a* extending in the longitudinal direction of the toner storage portion 61 and is rotatably supported in the toner storage portion 61. The crank bar 80 further includes a bar main body 80*b* located radially outward of the rotation shaft 80*a* and extending parallel to the rotation shaft 80*a*. The rotation shaft 80*a* and the bar main body 80*b* form a crank shape. The rotation shaft 80*a* defines a rotation axis of the crank bar 80.

The agitating plate 81 (also referred to as an upper agitating plate) is mounted to the crank bar 80. The agitating plate 81 has ten shaft-receiving portions 84 (i.e., five pairs of the shaft-receiving portions 84) provided along a lower end 812 of the agitating plate 81. The shaft receiving portions 84 engage the bar main body 80*b* of the bar crank bar 80.

Figure 4B:
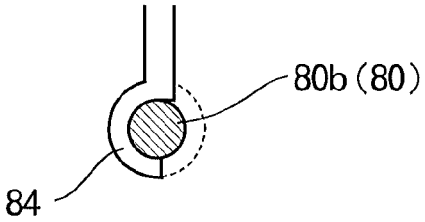
FIG. 4B is a schematic view showing an engaging portion between the crank bar and the agitating plate.

FIG. 4B is a schematic cross sectional view showing an engagement between the shaft-receiving portions 84 and the crank bar 80. Each shaft-receiving portion 84 has a substantially semicylindrical shape, and engages the bar main body 80*b* of the crank bar 80 from outside. Each pair of the shaft-receiving portions 84 face in the same direction, and adjacent pairs of the shaft-receiving portions 84 face in opposite directions.

The agitating plate 81 has an upper end 811 which is a free end (i.e., not fixed) that comes into contact with the wall 61*a* of the toner storage portion 61 as described later.

As shown in FIG. 3, a protrusion 64 (as a regulating member) is formed in the toner storage portion 61. The protrusion 64 protrudes from a side end of the toner storage portion 61, and is positioned above the agitating plate 81. The protrusion 64 regulates an amount of separation (uplift) of the agitating plate 81 from the wall 61*a*. The agitating plate 81 (a first agitating member) swings along the wall 61*a* in conjunction with the rotation of the crank bar 80. The above described agitating member 70 (a second agitating member) is located below the agitating plate 81, and is located above the supply opening 63.

The waste toner storage portion 62 is provided below the wall 61*a*. The waste toner storage portion 62 stores the waste toner corrected by the cleaning blade 29.

Figure 5:
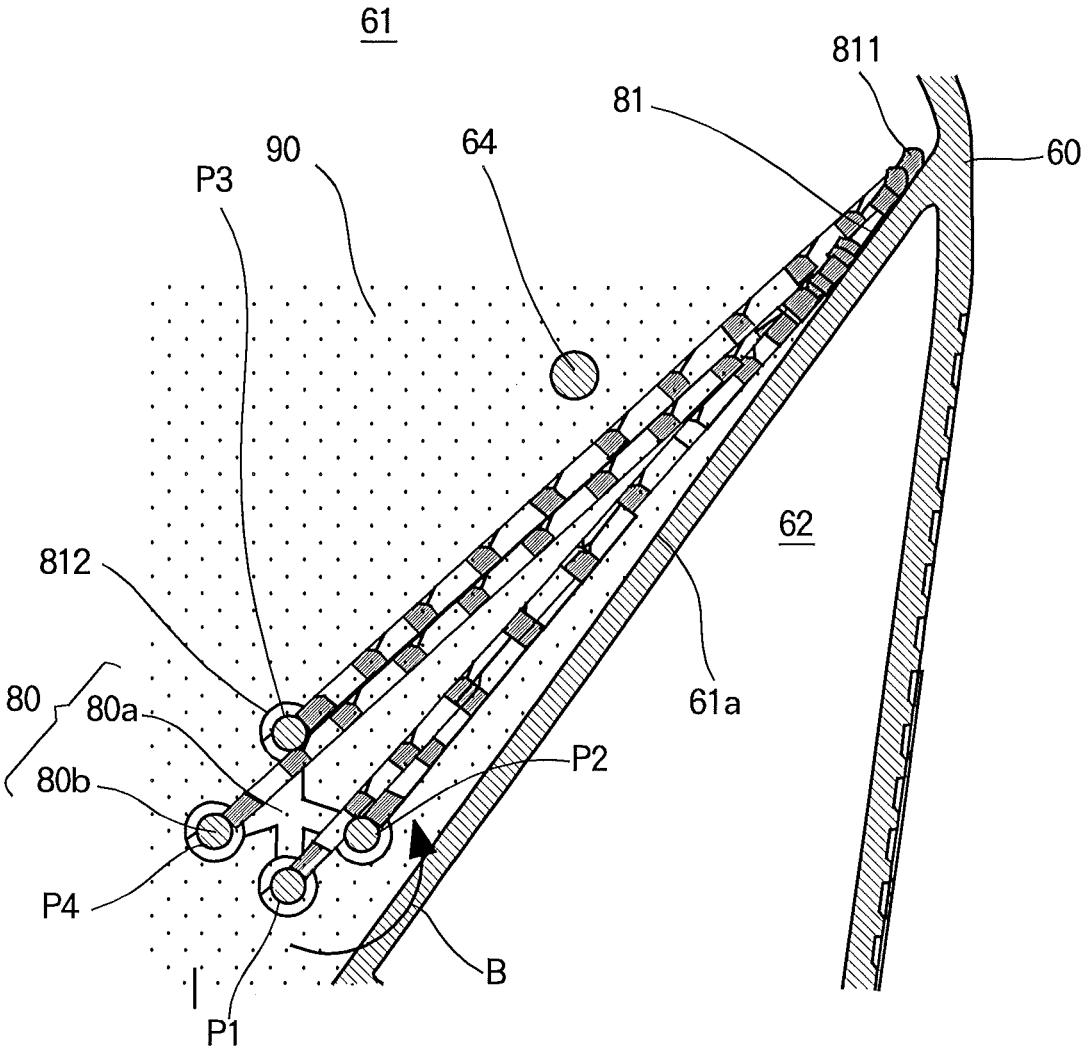
FIG. 5 is an enlarged sectional view showing a part of the toner cartridge according to the first embodiment of the present invention.

FIG. 5 is an enlarged sectional view showing a part of the toner cartridge 60 indicated by a square A in FIG. 3.

As shown in FIG. 5, when the crank bar 80 rotates, the lower end 812 of the agitating plate 81 moves in conjunction with the rotation of the crank bar 80 as shown by marks P1, P2, P3 and P4.

Figure 6:
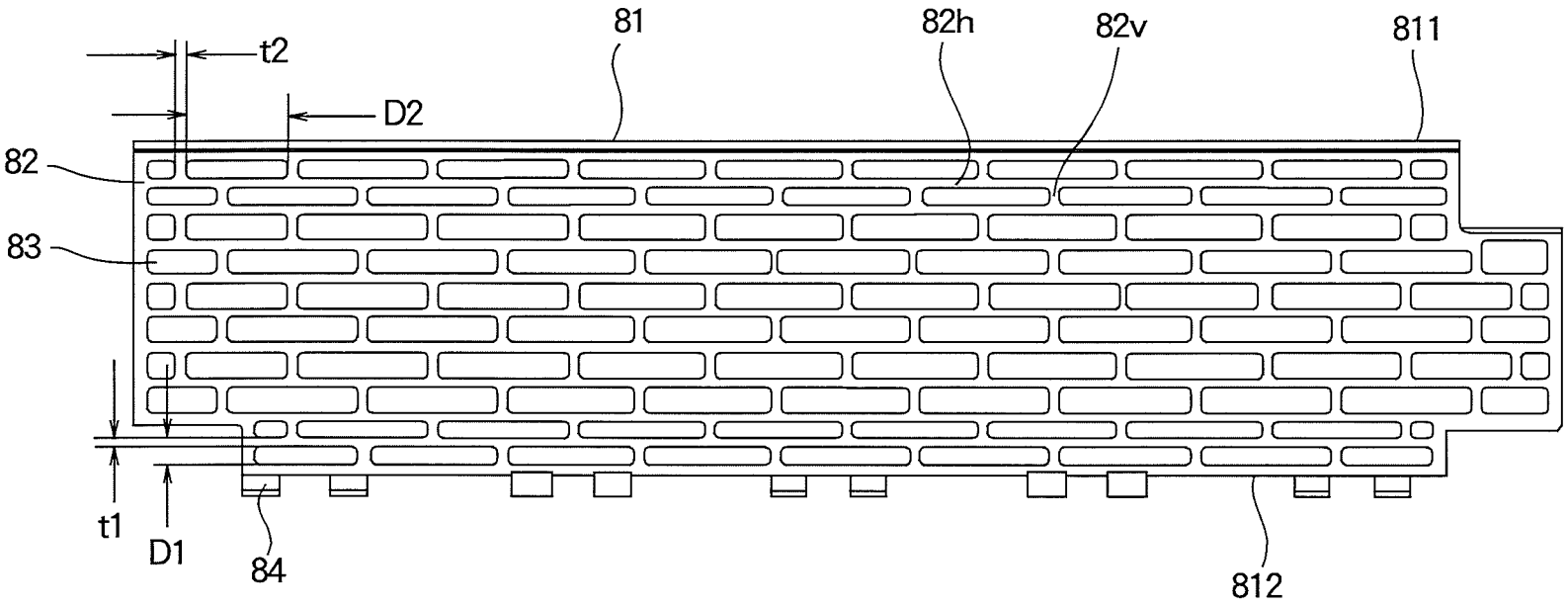
FIG. 6 is a plan view showing the agitating plate according to the first embodiment of the present invention.

FIG. 6 is a plan view of the agitating plate 81 according to the first embodiment. FIG. 6 also shows dimensions of a rib 82 of the agitating plate 81.

The agitating plate 81 has a planar shape and is composed of ABS (Acrylonitrile Butadiene Styrene) resin. The agitating plate 81 has a substantially rectangular shape whose upper right corner and lower left and right corners are cut out. The agitating plate 81 has a plurality of elongated ribs 82 which are regularly arranged. The ribs 82 straightly extend throughout the length of the agitating plate 81 in a longitudinal direction of the agitating plate 81 (i.e., in horizontal direction) to form horizontal rib-parts 82*h*. The ribs 82 further extend in a widthwise direction of the agitating plate 81 (i.e., in vertical direction) to form vertical rib-parts 82*v* connecting the horizontal rib-parts 82*h*. Along the widthwise direction of the agitating plate 81, vertical rib-parts 82*v* are alternately shifted in the longitudinal direction of the agitating plate 81. Opening portions 83 are formed by being surrounded by the ribs 82. The opening portion 83 has a rectangular shape whose corners are rounded.

In the widthwise direction of the agitating plate 81, a width of the rib 82 is expressed as t1, and a width of the opening portion 83 is expressed as D1. In the longitudinal direction of the agitating plate 81, a width of the rib 82 is expressed as t2, and a length of the opening portion 83 is expressed as D2. In this embodiment, the width t1 and the width t2 are both 1.5 mm (t1=t2=1.5 mm), the width D1 is 5 mm, and the length D2 is 24 mm. In this embodiment, the rib 82 has a rectangular cross sectional shape. However, it is also possible that the rib 82 has a circular cross sectional shape.

<Operation>

Next, an operation of the image forming apparatus 10 will be described with reference to FIG. 1.

The recording medium 100 is transported along the transport path 101 from the upstream to the downstream. The feeding cassette 110 is disposed on the upstream end of the transport path 101, and the stacker portion 52 is disposed on the downstream end of the transport path 101.

The image forming apparatus 10 is connected to a host device using a wire or wirelessly. When the image forming apparatus 10 receives printing instruction and printing data from the host device, the pickup roller 12 starts rotating by a pickup motor (not shown), and feeds the recording medium 100 one by one into the transport path 101. The hopping sensor 13 detects whether the pickup roller 12 correctly feeds the recording medium 100. If it is detected that the pickup roller 12 does not correctly feed the recording medium 100, the pickup roller 12 again rotates to feed the recording medium 100. The image forming portion 20 causes the photosensitive drum 23 and respective rollers to start rotating at substantially the same time as the starting of the feeding of the recording medium 100. The photosensitive drum 23 rotates at least one turn before the recording medium 100 reaches the photosensitive drum 23.

When the feeding roller 14*a* starts rotating by the feeding motor (not shown), the retard roller 14*b* rotates accompanying the rotation of the feeing roller 14*a*. The feeding roller 14*a* and the retard roller 14*b* nip and feed the recording medium 100 (fed by the pickup roller 12) to the transport rollers 15*a* and 15*b* on downstream side along the transport path 101.

When the recording medium 100 reaches the transport rollers 15*a* and 15*b*, the recording medium 100 may be inclined (i.e., skew) due to friction applied by the pickup roller 12 and the feeding roller 14*a*. The recording medium 100 abuts against the transport rollers 15*a* and 15*b* before the transport rollers 15*a* and 15*b* start rotating, so that the skew of the recording medium 100 is corrected. Then, rotation is transmitted to the transport rollers 15*a* and 15*b* via a clutch, and the transport rollers 15*a* and 15*b* start rotating.

The recording medium 100 is transported by the transport rollers 15*a* and 15*b*, and causes the writing sensor 16 to be turned ON. When a predetermined time has passed after the writing sensor 16 is turned ON, the LED head 25 starts emitting light to expose the surface of the photosensitive drum 23, so as to form a latent image on the surface of the photosensitive drum 23.

When the registration roller 17*a* starts rotating by the registration motor (not shown), the registration roller 17*b* rotates contacting the registration roller 17*a*. The registration rollers 17*a* and 17*b* transport the recording medium 100 to the image forming portion 20 on downstream side along the transport path 101.

In the image forming portion 20, the photosensitive drum 23 rotates clockwise in FIG. 1, and the charging roller 24 uniformly charges the surface of the photosensitive drum 23. The LED head 25 emits light to expose the uniformly charged surface of the photosensitive drum 23 based on image data to form a latent image. The developing roller 27 is supplied with the toner by the sponge roller 26, and develops the latent image on the surface of the photosensitive drum 23 to form a toner image. The photosensitive drum 23 and the transfer roller nip the recording medium 100 therebetween, and the transfer roller 21 is applied with a transfer voltage of +3000V, so that the toner image is transferred from the photosensitive drum 23 to the recording medium 100. The recording medium 100 with the toner image is transported to the fixing portion 40. The toner 90 remaining on the surface of the photosensitive drum 23 is scraped off by the cleaning blade 29. The scraped-off toner (i.e., waste toner) is collected by a collection mechanism (not shown), and stored in the waste toner storage portion 62 of the toner cartridge 60.

In the fixing portion 40, the recording medium 100 is nipped by the fixing roller 41 and the backup roller 42 and is fed through a nip portion between the fixing roller 41 and the backup roller 42. The toner is applied with heat and pressure by the fixing roller 41 and the backup roller 42 and is molten, so that the toner image is fixed to the recording medium 100.

The recording medium 100 with the fixed toner image is transported by the rotation of the ejection rollers 50*a*, 50*b*, 51*a* and 51*b*, and is ejected outside the image forming apparatus 100. The ejected recording medium 100 is placed on the stacker portion 52.

Next, an operation of the image forming portion 20 will be described with reference to FIG. 2.

The charging roller 24 applies a uniform voltage to the surface of the photosensitive drum 23, so that the surface of the photosensitive drum 23 uniformly charged. The uniformly charged surface of the photosensitive drum 23 is exposed with light emitted by the LED head 25. By exposure, electric charge of an image portion is removed, and a latent image is formed on the surface of the photosensitive drum 23. The toner cartridge 60 is disposed on the image forming unit main body 22, and the toner 90 is supplied from the toner cartridge 60 to the image forming unit main body 22. In the image forming unit main body 22, the toner 90 supplied by the toner cartridge 60 is supplied to the developing roller 27 by the sponge roller 26, and is regulated to a constant thickness by the developing blade 28. The developing roller 27 develops the latent image on the surface of the photosensitive drum 23 using the toner 90, and forms the toner image. The toner image on the surface of the photosensitive drum 23 is transferred to the recording medium 100 by the transfer roller 21.

Next, an operation of the toner cartridge 60 according to the first embodiment will be described with reference to FIGS. 3 and 5.

As shown in FIG. 3, the agitating member 70 is driven by a driving motor (not shown) provided in the image forming unit main body 22 to rotate in a direction indicated by an arrow A. The rotation of the agitating member 70 is transmitted to the crank bar 80 by means of the gear train, and the crank bar 80 rotates in a direction indicated by an arrow B.

The shaft-receiving portions 84 of the lower end 812 of the agitating plate 81 engage the crank bar 80 as described above. When the crank bar 80 rotates counterclockwise as shown by the marks P1, P2, P3, P4 and P1 in this order (FIG. 5), the lower end 812 of the agitating plate 81 rotates in conjunction with the rotation of the crank bar 80. The upper end 811 of the agitating plate 81 is a free end, and the protrusion 64 regulates the amount of separation of the agitating plate 81 from the wall 61*a*. Therefore, the upper end 811 of the agitating plate 81 moves (swings) upward and downward along an inclined surface 61*d* of the wall 61*a* in the toner storage portion 61 in conjunction with the rotation of the crank bar 80. As the agitating plate 81 moves upward and downward along the wall 61*a*, the toner 90 in the vicinity of wall 61*a* is agitated upward and downward along the wall 61*a* by the rib 82 of the agitating plate 81.

The toner in the vicinity of the wall 61*a* is agitated by the agitating plate 81, and moves toward the agitating member 70. Then, the toner reaching the vicinity of the agitating member 70 is agitated by the agitating member 70, and is supplied to the image forming unit main body 22 via the supply opening 63.

Thus, flocculation of the toner 90 in the vicinity of the wall 61*a* of the toner storage portion 61 can be prevented.

<Advantages>

The toner cartridge 60, the image forming unit 20*a* and the image forming apparatus 10 of the first embodiment provide the following advantages.

The agitating plate 81 swings upward and downward along the inclined surface 61*d* of the wall 61*a* of the toner storage portion 61 to agitate the toner 90 in the vicinity of the wall 61*a*. Therefore, flocculation of the toner 90 in the vicinity of the wall 61*a* is prevented. Further, the toner moves toward the agitating member 70, and is supplied to the image forming unit main body 22 via the supply opening 63. Therefore, it becomes possible to prevent the toner 90 from remaining in the toner cartridge 60.

Furthermore, the agitating plate 81 has the ribs 82, and therefore the agitating plate 81 is able to efficiently agitate the toner 90 in the toner storage portion 61. Thus, flocculation of the toner 90 can be effectively prevented.

Modifications

Figure 7:
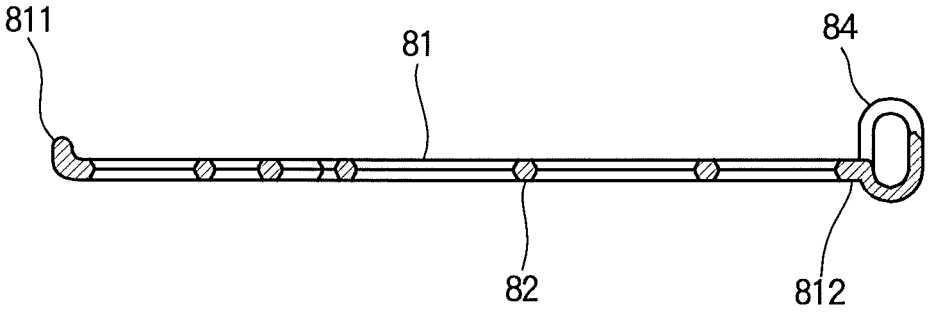
FIG. 7 shows an alternative example of the agitating plate according to the first embodiment of the present invention.

FIG. 7 is a cross sectional view of showing a modification of the agitating plate 81. In this modification, the shaft-receiving portion 84 of the agitating plate 81 has an elongated shape. To be more specific, the shaft-receiving portion 84 is elongated in a direction perpendicular to the longitudinal direction and width direction of the agitating plate 81. With such a structure, the bar main body 80*b* of the crank bar 80 is movable relative to the shaft-receiving portion 84 of the agitating plate 81.

Figure 8A:
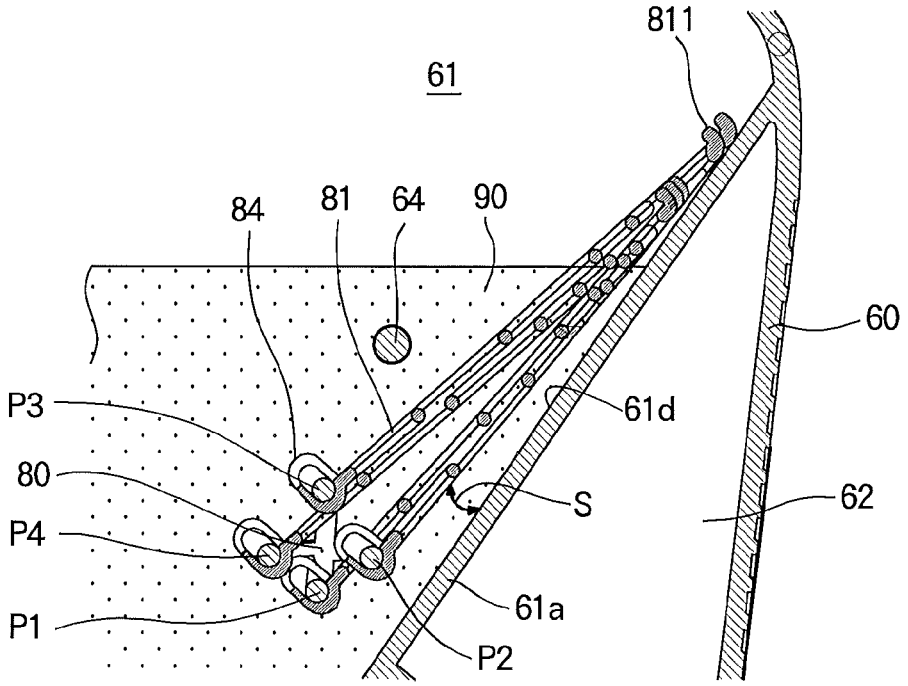
FIGS. 8A and 8B show an operation of the agitating plate shown in FIG. 7.
Figure 8B:
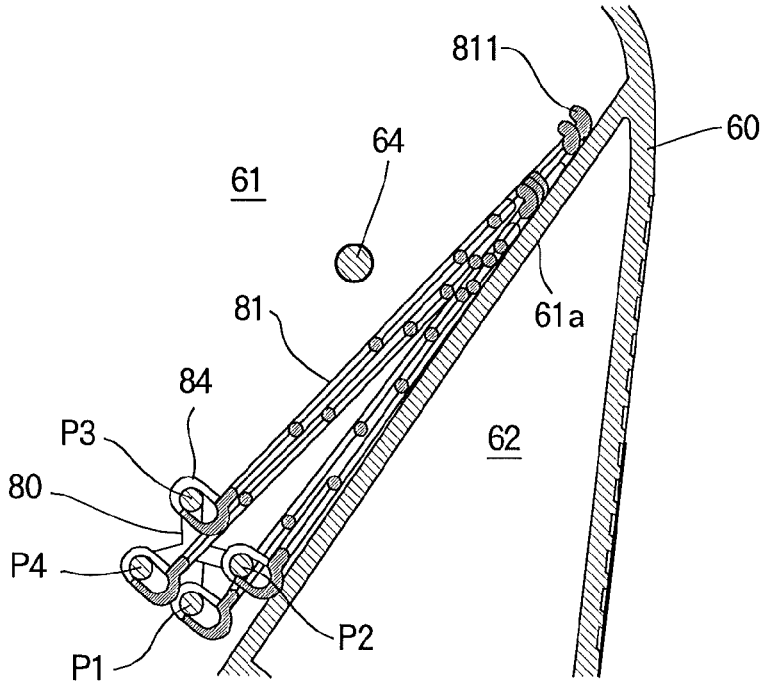

FIGS. 8A and 8B show operation of the agitating plate 81 of FIG. 7.

When a large amount of the toner 90 is stored in the toner storage portion 61, the agitating plate 81 moves as shown in FIG. 8A. In this case, when the agitating plate reaches the closest to the wall 61*a*, the shaft-receiving portion 84 of the agitating plate 81 is apart from the wall 61*a*, and a space S is left between the agitating plate 81 and the inclined surface 61*d* of the wall 61*a*.

In contrast, when a small amount of the toner 90 is stored in the toner storage portion 61, the agitating plate 81 moves as shown in FIG. 8B. In this case, when the agitating plate 81 reaches to the closest to the wall 61*a*, the shaft-receiving portion 84 of the agitating plate 81 contacts the wall 61*a*. That is, the agitating plate 81 entirely moves in the vicinity of the wall 61*a*.

Therefore, according to the modification (FIGS. 7, 8A and 8B), the toner 90 accumulated in the vicinity of the wall 61*a* can be agitated when a small amount of the toner 90 is stored in the toner storage portion 61. Further, since the shaft-receiving portion 84 of the agitating plate 81 contacts the wall 61*a*, the toner 90 adhering to the wall 61*a* can be scraped off by the shaft-receiving portion 84.

Second Embodiment

<Configuration>

Figure 9A:
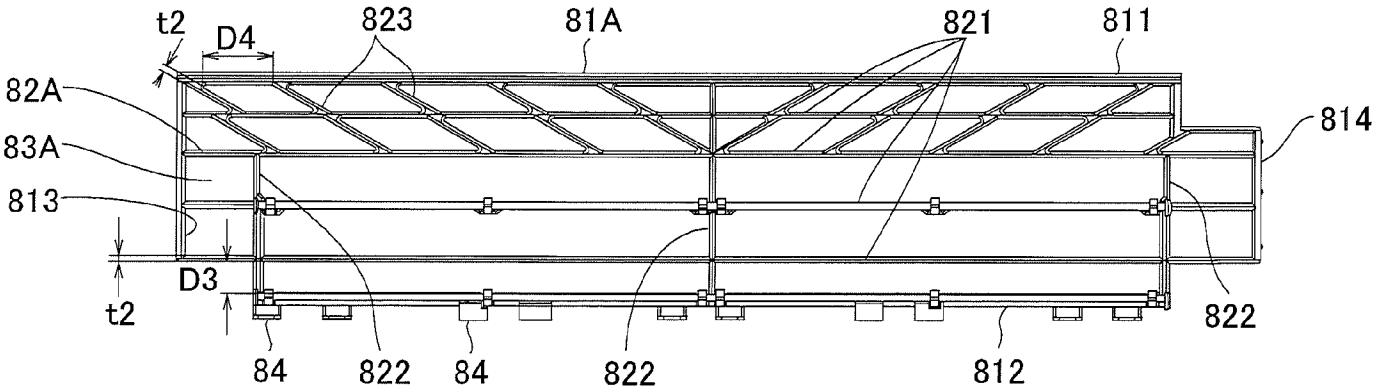
FIG. 9A is a plan view showing an agitating plate according to the second embodiment of the present invention.

FIG. 9A is a plan view showing an agitating plate 81A of the second embodiment of the present invention.

The agitating plate 81A of the second embodiment is formed of ABS resin as in the first embodiment. Further, the agitating plate 81A has a substantially rectangular shape whose upper right corner and lower left and right corners are cut out as in the first embodiment.

The agitating plate 81A includes an upper end 811, a lower end 812, a left end 813 and a right end 814 respectively formed of ribs.

The agitating plate 81A further includes ribs 82A which are different from the ribs 82 of the agitating plate 81 of the first embodiment. The ribs 82A include four horizontal rib-parts 821 extending in the longitudinal direction of the agitating plate 81A, and three vertical rib-parts 822 extending in the widthwise direction of the agitating plate 81A. Among the three vertical rib-parts 822, the center vertical rib-part 822 extends between the upper end 811 and the lower end 812 of the agitating plate 81A, and remaining two vertical rib-parts 822 extend between the second top horizontal rib-part 821 and the lower end 812 of the agitating plate 81A.

The ribs 82A further include ten inclined rib-parts 823 extending between the upper end 811 of the agitating plate 81A and the second top horizontal rib-part 821.

Figure 9B:
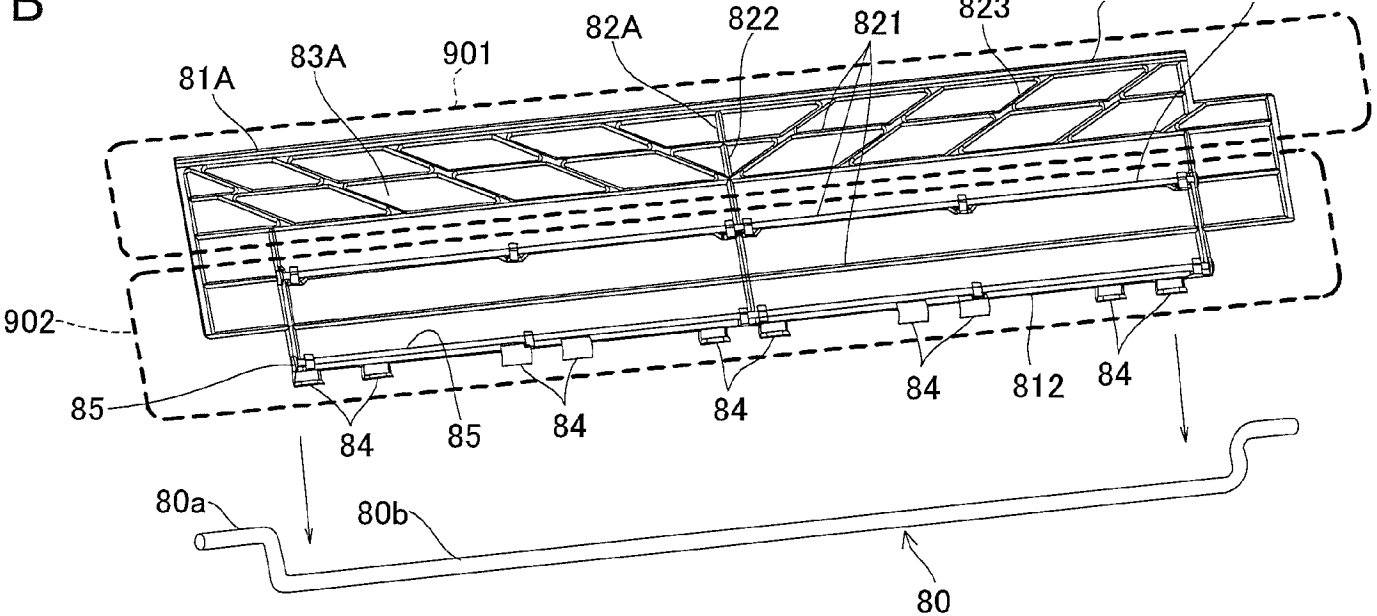
FIG. 9B is a schematic view showing the agitating plate and a crank bar according to the second embodiment of the present invention.

FIG. 9B shows the agitating plate 81A and the crank bar 80. An upper section 901 of the agitating plate 81A is defined as including a region from the upper end 811 of the agitating plate 81A to the second top horizontal rib-part 821. A lower section 902 of the agitating plate 81A is defined as including a region from the third top horizontal rib-part 821 to the lower end 812 of the agitating plate 81A. Since the upper section 901 of the agitating plate 81A includes ten inclined rib-parts 823, the number of ribs 82A is larger in the upper section 901 than in the lower section 902.

As shown in FIG. 9A, a width of the rib 82A is expressed as t2. A width of the opening portion 83A of the lower section 902 is expressed as D3. A length of the opening portion 83A of the upper section 901 is expressed as D4. In this example, the width t2 is 1.5 mm, the width D3 of the opening portion 83A (of the lower section 902) is 11.5 mm, and the length D4 of the opening portion 83A (of the upper section 901) is 16.9 mm. The ribs 82A are disposed at high density in the upper section 901 of the agitating plate 81, and disposed at low density in the lower section 902 of the agitating plate 81. In other words, opening portions 83A formed by the ribs 82A are smaller in the upper section 901 (farther from the crank bar 80) than in the lower section 902 (closer to the crank bar 80).

The agitating plate 81A has ten shaft-receiving portions 84 as in the first embodiment. The shaft-receiving portions 84 engage the bar main body 80*b* of the crank bar 80 as in the first embodiment. Adjacent pairs of the shaft-receiving portions 84 face in opposite directions.

Unlike the agitating plate 81 of the first embodiment, the agitating plate 81A of the second embodiment has metal rods 85 and 86 as rod-shaped members. The metal rods 85 and 86 are made of metal such as stainless steel or steel. The metal rod 85 is mounted to the lower end 812 of the agitating plate 81A. The metal rod 86 is mounted to the third top horizontal rib-part 821.

A rigidity of the agitating plate 81A is enhanced by the metal rods 85 and 86 (i.e., rod-shaped members) extending parallel to the crank bar 80.

Figure 10:
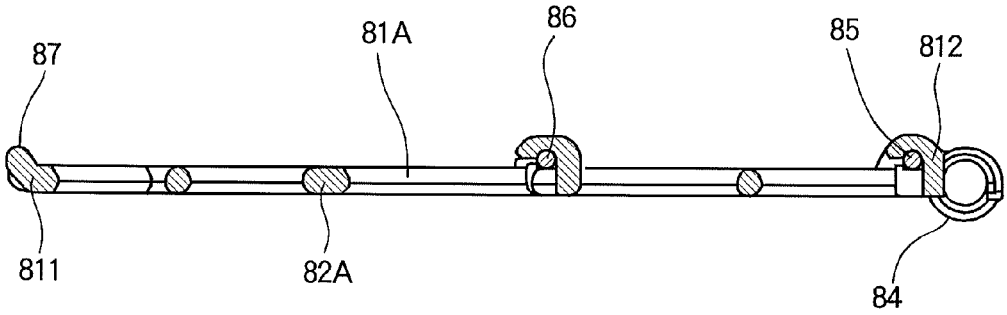
FIG. 10 is a sectional view of an agitating plate according to the second embodiment of the present invention.

FIG. 10 is a cross sectional view of the agitating plate 81A according to the second embodiment. The upper end 811 of the agitating plate 81A is shown in the left in FIG. 11.

The agitating plate 81A has a bent portion 87 formed on the upper end 811, i.e., an end opposite to the shaft-receiving portion 84. The metal rod 85 is mounted to the lower end 812, and the metal rod 86 is mounted to the third top horizontal rib-part 821 as described above. The bent portion 87 and the metal rods 85 and 86 enhance the rigidity of the agitating plate 81A.

<Operation>

Next, an operation of the agitating plate 81A will be described with reference to FIGS. 3, 5, 9A, 9B and 10.

As was described in the first embodiment, the lower end 812 of the agitating plate 81A of the second embodiment rotates counterclockwise as shown by the marks P1, P2, P3, P4 and P1 in FIG. 5 in this order in conjunction with the crank bar 80 as shown by arrow B. During the rotation of the lower end 812 of the agitating plate 81A, the lower end 812 of the agitating plate 81A moves closer to the wall 61*a* of the toner storage portion 61 as indicated by the marks P3, P4 and P1. In this state, if the agitating plate 81A has a large number of ribs 82A (as the agitating plate 81 of the first embodiment), the agitating plate 81A pushes the toner 90 at a large area. Therefore, the agitating plate 81A is subject to a large load from the toner 90, and a rotational load on the agitating plate 81A increases.

Therefore, the agitating plate 81A of the second embodiment is configured to have a large area of the opening portions 83A in the lower section 902 as shown in FIGS. 9A and 9B. With such a structure, the load applied to the agitating plate 81A by the toner 90 can be reduced as compared with the agitating plate 81 of the first embodiment. Thus, the rotational load on the agitating plate 81A can be reduced.

As shown in FIG. 3, the toner 90 accumulated in the lower part of the toner storage portion 61 is pressed by a weight of the toner 90 accumulated thereon, and therefore agglomeration degree of the toner 90 in the lower part of the toner storage portion 61 increases. Therefore, by reducing the number of the ribs 82A (i.e., by increasing the area of the opening portions 83A) in the lower section 902 of the agitating plate 81A, the rotation load on the agitating plate 81A can be reduced.

In this regard, it is not necessary to reduce the number of ribs 82A in the upper section 901 of the agitating plate 81A, since the agglomeration degree of the toner 90 in the upper part of the toner storage portion 61 (corresponding to the upper section 901 of the agitating plate 81A) is relatively low.

Further, if the rigidity of the agitating plate 81A is low, the agitating plate 81A may be deformed due to resistance of the toner 90. If such a deformation occurs, the resistance of the toner 90 to the agitating plate 81A may further increase, and the rotational load on the agitating plate 81A may increase. Further, the shaft-receiving portion 84 may be deformed, and the shaft-receiving portion 84 and the crank bar 80 may make sliding contact with each other, which may further increase the rotational load on the agitating plate 81A. Therefore, in the second embodiment, the agitating plate 81A is configured to have high rigidity by being provided with the metal rods 85 and 86 and the bent portion 87.

In this regard, if the agitating plate 81A is made of metal (instead of resin), the agitating plate 81A can have high rigidity without using the metal rods 85 and 86.

<Advantages>

The toner cartridge 60, the image forming unit 20*a* and the image forming apparatus 10 of the second embodiment provide the following advantages, in addition to the advantages of the first embodiment.

The resistance to the agitating plate 81A applied by the toner 90 can be reduced by reducing the number of the ribs 82A (i.e., by increasing the area of the opening portions 83A) in the lower section 902 of the agitating plate 81A. As a result, the rotational load on the agitating plate 81A can be reduced.

Further, the rigidity of the agitating plate 81A can be enhanced by mounting the metal rods 85 and 86 to the ribs 82A of the lower section 902 of the agitating plate 81A, and by providing the bent portion 87 on the upper end 811 of the agitating plate 81A. Further, due to the high rigidity, the agitating plate 81A is not deformed, and therefore the resistance to the agitating plate 81A applied by the toner 90 can be reduced, and the rotational load on the agitating plate 81A can be reduced. Furthermore, the crank bar 80 and the shaft-receiving portions 84 of the agitating plate 81A do not make sliding contact, and therefore the rotational load on the agitating plate 81A can be further reduced.

Various modifications can be made to the above described embodiments.

For example, in the first and second embodiments, the printer has been described as an example of the image forming apparatus. However, the present invention is applicable to a facsimile machine, a copy machine, a multifunction peripheral or the like, and is applicable to a developer storage container and an image forming unit used therein.

Further, in the first and second embodiments, the agitating plates 81 and 81A are made of ABS resin. However, the agitating plates 81 and 81A can be made of other resin such as polystyrene resin or polycarbonate resin. Furthermore, the agitating plates 81 and 81A can be made of metal such as stainless or steel.

Moreover, the metal rods 85 and 86 of the second embodiment can be made of metal (such as steel) other than stainless.

In the first and second embodiment, the lower ends 812 of the agitating plates 81 and 81A engage the crank bar 80 for a conjunction of movement. However, it is also possible that the crank bar 80 is located in the upper part of the toner storage portion 61, and the upper part of the agitating plate 81 (81A) engages the crank bar 80 for a conjunction of movement.

In the first and second embodiments, the crank bar 80 is rotated, and the lower ends 812 of the agitating plates 81 and 81A engage the crank bar 80. However, it is also possible that the crank bar 80 is configured to move horizontally or vertically, and the agitating plate 81 (81A) engages the crank bar 80 for a conjunction of movement. Further, it is also possible that the crank bar 80 is configured to move horizontally or vertically in the upper part of the toner storage portion 61, and the upper part of the agitating plate 81 (81A) engages the crank bar 80 for a conjunction of movement.

In the second embodiment, the agitating plate 81A is divided into the upper section 901 and the lower section 902, and the number of the ribs 82A is larger in the upper section 901 than in the lower section 902. In other words, the area of the opening portions 83A is larger in the lower section 902 than in the upper section 901. However, it is also possible that the agitating plate 81A is divided into upper, middle and lower sections, and the number of the ribs 82A decreases in the order of the upper, middle and lower sections, so that the area of the opening portions 83A increases in the order of the upper, middle and lower sections. It is also possible that the number of the ribs 82A continuously decreases from the top to the bottom of the agitating plate 81A so that the area of the opening portions 83A continuously increases from the upper end 811 to the lower end 812 of the agitating plate 81A.

While the preferred embodiments of the present invention have been illustrated in detail, it should be apparent that modifications and improvements may be made to the invention without departing from the spirit and scope of the invention as described in the following claims.

What is claimed is:

1. A developer storage container comprising:

a developer storage portion in which a developer is stored, said developer storage portion having a wall;

a rotating body rotatably provided in said developer storage portion;

an agitating plate having a first end engaging said rotating body and a second end as a free end, said second end reciprocally moving along said wall, said agitating plate having a rod-shaped member which extends parallel to said rotating body; and a regulating member provided in said developer storage portion so that said agitating plate is located between said regulating member and said wall, wherein said regulating member is provided at a distance from said agitating plate in such a manner that said regulating member is contactable with said agitating plate by a movement of the agitating plate, wherein when said agitating plate contacts said regulating member, said regulating member restricts movement of said agitating plate in a direction substantially perpendicular to a moving direction of said second end, and wherein as said agitating plate moves along said wall, an angle between said agitating plate and said wall changes.

2. The developer storage container according to claim 1, wherein said first end is a lower end of said agitating plate.

3. The developer storage container according to claim 1, wherein said rotating body has a rotation shaft and a bar main body, wherein said bar main body rotates about said rotation shaft.

4. The developer storage container according to claim 1, wherein said wall has an inclined surface.

5. The developer storage container according to claim 1, wherein said rod-shaped member is made of stainless steel or steel.

6. The developer storage container according to claim 1, wherein an outlet opening is formed on a bottom of said developer storage portion.

7. The developer storage container according to claim 6, further comprising an agitating member in the vicinity of said outlet opening.

8. The developer storage container according to claim 7, wherein said agitating member is provided below said agitating plate.

9. An image forming unit comprising:

an image forming unit main body; and the developer storage container according to claim 1, mounted to the image forming unit main body.

10. An image forming apparatus comprising:

a feeding portion that feeds a recording medium;

the image forming unit according to claim 9, the image forming unit forming a developer image on the recording medium; and a fixing portion that fixes the developer image to the recording medium.

11. The developer storage container according to claim 1, wherein said agitating plate reciprocally moves in a region between said wall and said regulating member, wherein the regulating member prevents said agitating plate from separating from said wall by a predetermined amount.

12. The developer storage container according to claim 1, wherein said wall has an inclined surface, wherein said developer storage portion has a substantially vertical wall surface facing said inclined surface in a direction perpendicular to a longitudinal direction of said developer storage portion, and wherein said regulating member is disposed between said substantially vertical wall surface and said agitating plate, said regulating member being disposed closer to said inclined surface than to said substantially vertical wall surface.

13. A developer storage container comprising:

a developer storage portion in which a developer is stored, said developer storage portion having a wall;

a rotating body rotatably provided in said developer storage portion;

an agitating plate having a first end engaging said rotating body and a second end as a free end, said second end reciprocally moving along said wall, said agitating plate having a plurality of ribs that define opening portions therebetween, said agitating plate having a rod-shaped member which extends parallel to said rotating body; and a regulating member provided in said developer storage portion so that said agitating plate is located between said regulating member and said wall, wherein said regulating member is provided at a distance from said agitating plate in such a manner that said regulating member is contactable with said agitating plate by a movement of the agitating plate, wherein when said agitating plate contacts said regulating member, said regulating member restricts movement of said agitating plate in a direction substantially perpendicular to a moving direction of said second end, wherein as said agitating plate moves along said wall, an angle between said agitating plate and said wall changes, and wherein an area of said opening portions is larger in a lower section of said agitating plate than in an upper section of said agitating plate.

14. The developer storage container according to claim 13, wherein said wall has an inclined surface.

15. An image forming unit comprising:

an image forming unit main body; and the developer storage container according to claim 13, mounted to the image forming unit main body.

16. An image forming apparatus comprising:

a feeding portion that feeds a recording medium;

the image forming unit according to claim 15, the image forming unit forming a developer image on the recording medium; and a fixing portion that fixes the developer image to the recording medium.

17. The developer storage container according to claim 13, wherein said agitating plate reciprocally moves in a region between said wall and said regulating member, wherein the regulating member prevents said agitating plate from separating from said wall by a predetermined amount.

18. The developer storage container according to claim 13, wherein said wall has an inclined surface, wherein said developer storage portion has a substantially vertical wall surface facing said inclined surface in a direction perpendicular to a longitudinal direction of said developer storage portion, and wherein said regulating member is disposed between said substantially vertical wall surface and said agitating plate, said regulating member being disposed closer to said inclined surface than to said substantially vertical wall surface.

19. A developer storage container comprising:

a developer storage portion in which a developer is stored, said developer storage portion having a wall;

a rotating body rotatably provided in said developer storage portion;

an agitating plate having a first end engaging said rotating body and a second end as a free end, said second end reciprocally moving along said wall, said agitating plate having a rod-shaped member which extends parallel to said rotating body; and a regulating member provided in said developer storage portion so that said agitating plate is located between said regulating member and said wall, said regulating member being disposed at a position closer to said second end than to said first end so that an interval is formed between said regulating member and said agitating plate, wherein said regulating member is provided at a distance from said agitating plate in such a manner that said regulating member is contactable with said agitating plate by a movement of the agitating plate, wherein when said agitating plate contacts said regulating member, said regulating member restricts movement of said agitating plate in a direction substantially perpendicular to a moving direction of said second end, and wherein as said agitating plate moves along said wall, an angle between said agitating plate and said wall changes.

20. The developer storage container according to claim 19, wherein said regulating member regulates a separation of said second end of said agitating plate from said wall.

21. The developer storage container according to claim 19, wherein said wall has an inclined surface.

22. The developer storage container according to claim 19, wherein said agitating plate has a plurality of ribs that define opening portions therebetween.

23. The developer storage container according to claim 22, wherein an area of said opening portions is larger in a lower section of said agitating plate than in an upper section of said agitating plate.

24. An image forming unit comprising:

an image forming unit main body; and the developer storage container according to claim 19, mounted to the image forming unit main body.

25. An image forming apparatus comprising:

a feeding portion that feeds a recording medium;

the image forming unit according to claim 24, the image forming unit forming a developer image on the recording medium; and a fixing portion that fixes the developer image to the recording medium.

26. The developer storage container according to claim 19, wherein said agitating plate reciprocally moves in a region between said wall and said regulating member, wherein the regulating member prevents said agitating plate from separating from said wall by a predetermined amount.

27. The developer storage container according to claim 19, wherein said wall has an inclined surface, wherein said developer storage portion has a substantially vertical wall surface facing said inclined surface in a direction perpendicular to a longitudinal direction of said developer storage portion, and wherein said regulating member is disposed between said substantially vertical wall surface and said agitating plate, said regulating member being disposed closer to said inclined surface than to said substantially vertical wall surface.

* * * * *